United States Patent [19]

Sakurai et al.

[11] Patent Number: 4,752,803

[45] Date of Patent: Jun. 21, 1988

[54] BOARD RECORDING APPARATUS

[75] Inventors: Mitsuru Sakurai, Musashino; Yuichi Seki, Tokyo, both of Japan

[73] Assignee: Canon Kabushiki Kaisha, Tokyo, Japan

[21] Appl. No.: 75,992

[22] Filed: Jul. 21, 1987

[30] Foreign Application Priority Data

Jul. 25, 1986 [JP] Japan ..... 61-174984

[51] Int. Cl.[4] ..... G03G 15/00

[52] U.S. Cl. ..... 355/3 R; 355/5

[58] Field of Search ..... 355/3, 5, 49–51

[56] References Cited

U.S. PATENT DOCUMENTS 4,541,706 9/1985 Kishi ..... 355/3 R 4,687,318 8/1987 Shibasaki et al. ..... 355/5

*Primary Examiner*—Donald A. Griffin

*Attorney, Agent, or Firm*—Fitzpatrick, Cella, Harper and Scinto

[57] ABSTRACT

A board recording apparatus uses an electrophotographic copying apparatus for forming a copy of image information written on a movable sheet. The copying apparatus is movable between two positions, from a first position in which the apparatus is usable as a copying machine to a second position for copying the image information on the sheet, by rotation about a shaft supporting the copying apparatus.

11 Claims, 3 Drawing Sheets

BOARD RECORDING APPARATUS

BACKGROUND OF THE INVENTION

1. Field of the Invention

The present invention relates to a board recording apparatus having a function of forming a printout of a record on a writing board and a function of copying an original different from the board.

2. Related Background Art

Known apparatus of this kind are equipped with a printer for printing the record on a writing board movable between winding shafts or movable as an endless belt, and are exclusively used for recording of the board. Consequently, a separate copying machine is required for ordinary copying.

For resolving the above-mentioned inconvenience, a combination of a writing board and an electrophotographic apparatus has been proposed, as disclosed in the U.S. Pat. No. 4,648,706 or in the U.S. patent application Ser. No. 883,653 filed July 9, 1986.

SUMMARY OF THE INVENTION

An object of the present invention is to provide a novel board recording apparatus in which a copying machine is combined with a board. Another object of the present invention is to provide a board recording apparatus in which the positional aberration between the copying apparatus and the board is reduced. Still another object of the present invention is to provide a board recording apparatus capable of copying a large frame of the board with an electrophotographic copying apparatus through a simple optical system.

The foregoing objects can be achieved according to the present invention by an apparatus in which a copying machine unit set on the board is rendered rotatable toward the front or other direction about a shaft provided on the board, thereby being usable for board copying and for ordinary electrophotographic copying.

DETAILED DESCRIPTION OF THE PREFERRED EMBODIMENTS

Figure 1:
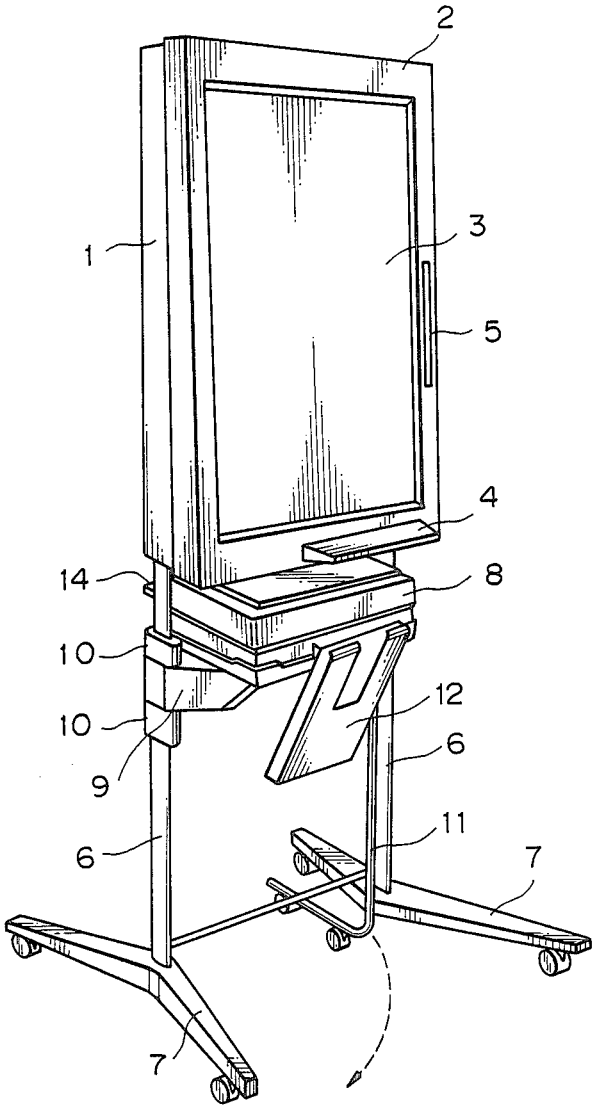
FIGS. 1 and 2 are perspective views of a board recording apparatus embodying the present invention.

FIG. 1 illustrates an embodiment of the present invention, in a state usable as an electronically copyable board.

In FIG. 1, a board unit 1 is provided therein with a light source 17, mirrors 18, a lens 19, and a polyethylene terephthalate sheet 3 constituting a writing board. Also illustrated are a front cover frame 2 covering the four edge portions of the board, sheet 3 on which an image is to be inscribed, a tray 4 for holding an eraser for erasing the image on the sheet, a pen for writing image on said sheet etc., an operation unit 5 for instructing image movement or copying, support pipes 6 for supporting the board unit and horizontal bases 7 for supporting the board unit, copying unit etc. Also included are an electrophotographic copying unit 8 for copying the image written on the sheet 3, a copying unit support 9 for supporting said copying unit, a hinge 10 for supporting said copying unit support 9, a pipe leg 11 eventually provided for supporting the copying unit support and a copy tray 12 for receiving the copy sheets after copying.

Figure 2:
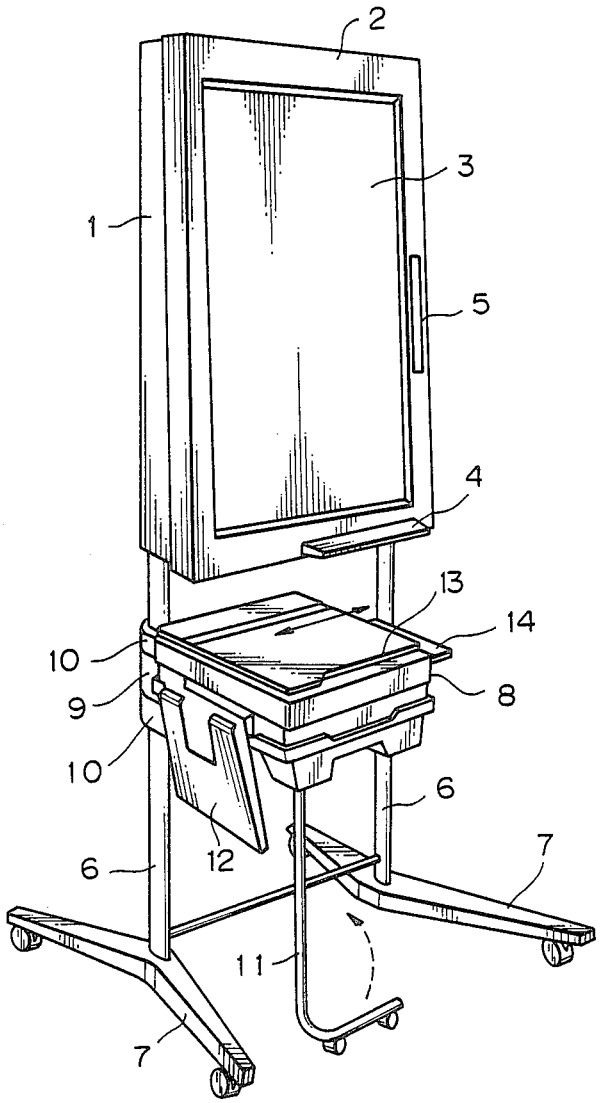

FIG. 2 illustrates a state in which the copying unit is rotated clockwise by 90° towards the front from a position under the board unit about said hinge 10, wherein the copying unit is usable as an ordinary copying machine. An original support 13 for supporting an original document is reciprocated in the copying operation as indicated by arrows, thereby exposing a photosensitive drum, to be explained later, to the image of said original document. A sheet tray 14 is provided for storing copy sheets.

Figure 3:
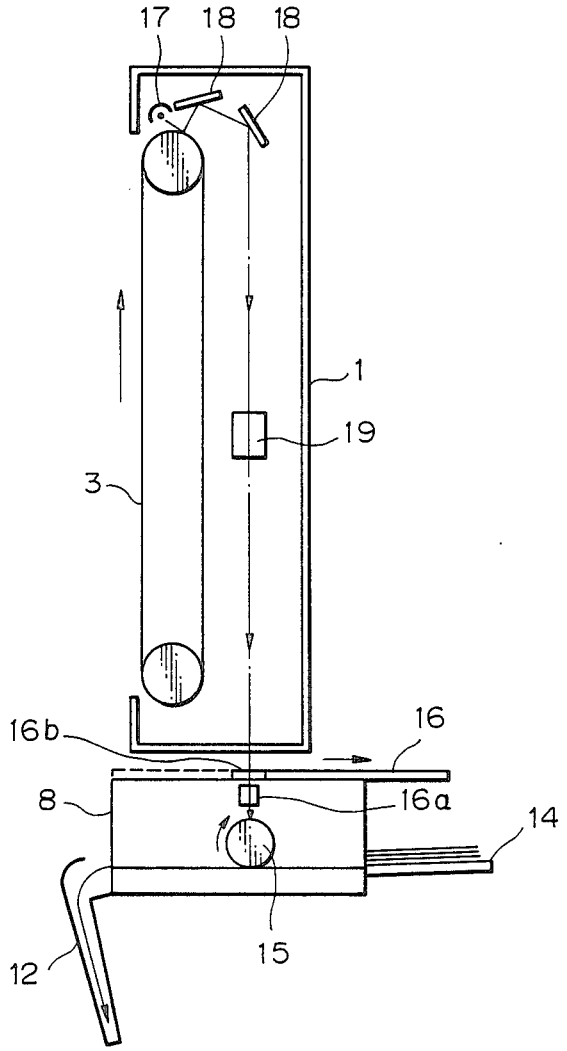
FIG. 3 is a schematic cross-sectional view of an image forming part of said apparatus.

FIG. 3 is a schematic cross-sectional view of the components related to the board copying function, wherein the board unit 1, the sheet 3, the copying unit 8, an electrophotographic photosensitive drum 15, a glass plate 16 for supporting an original in case use as a copying machine and a condenser lens 16*a* of the copying unit are shown. An image plane 16*b* is provided in a part of the glass plate 16 and composed, for example, of a fresnel lens. The light source 17, the mirrors 18, and the lens 19 are also shown. The image forming means provided around the drum 15 are already known and are therefore omitted.

In the following there will be explained the operation procedure in the mode of copyable board and in the mode of ordinary copying machine.

In the mode of the copyable board as shown in FIG. 1, an image is written on the endless sheet 3 for example with a marker pen containing aqueous ink. Then a copy start key on the operation unit 5 is actuated, whereby the sheet 3 shown in FIG. 3 is rotated by a half turn in a direction of the arrow by an unrepresented driving source, and the original supporting glass plate 16 is moved in a direction indicated by additional arrow. Through these operations an image is formed on the photosensitive drum 15 through the mirrors and lenses, and is transferred onto a copy sheet supplied from the sheet feed tray 14, and the completed copy is received by the copy tray 12. In this mode, the copying unit is locked, by an unrepresented locking mechanism, to the board unit in such a manner that it will not move during the copying operation.

In the mode of the ordinary copying machine as shown in FIG. 2, the locking mechanism is released and the copying unit 8 is rotated, together with the support 9, by 90 degrees clockwise toward the front, about the hinge 10. Then an original is set by opening the pressing plate 13. Copy sheets are placed on the tray 14 and the copy start key in the operation unit of the copying unit is actuated, whereby the original support is moved in the direction indicated by arrow, and copies are prepared on the copy sheets by the electrophotographic process. In order to distinguish the board copying mode from the ordinary copying mode there is provided an unrepresented switch, for example a microswitch, for detecting that the copying unit is placed in the position of the board copying mode shown in FIG. 1. It is therefore possible to automatically detect the board copying mode when said switch is actuated, or the ordinary copying mode when said switch is not actuated.

According to the present invention, the optical system can be simplified in the board copying mode since the rotary axis of the photosensitive drum 15 of the copying unit is parallel to the scanning direction of the sheet 3. In order to achieve parallel displacement of the copying unit from the position of the board copying mode to a position allowing manipulation of the cover on the original support for use as an ordinary copying machine, there will be required at least two rails for parallel displacement and a strong support member for supporting the copying unit. On the other hand, according to the present invention, the supporting method of the copying unit 8 is simplified since it is merely rotated about a support frame of the board unit 1.

Also the transition from the board copying mode to the ordinary copying mode is achieved by the rotation of the copying unit about a shaft. For this reason it is rendered possible, in the board copying mode, to discharge the copy sheet, after copying, in a direction orthogonal to the axis of the photosensitive drum, or in a direction toward the front of the board unit. On the other hand, in the ordinary copying mode, the copying unit is rotated by 90 degees, from the position under the board unit for board copying, toward the front. In this manner it is made easier to manipulate the original cover on the original support 13, to replenish the tray 14 with the copy sheets, and to collect the copy sheets discharged to the tray 12.

We claim:

1. A board recording apparatus capable of copying image information written on a sheet member with an eletrophotographic copying unit, comprising:

a board unit provided with sheet supporting members for movably supporting a sheet member on which the image information is to be recorded, and an optical system for guiding the image information recorded on the sheet member onto the copying unit;

an electrophotographic copying unit provided with an electrophotographic photosensitive member and an original support; and a copying unit support for supporting said copying unit, adapted to be rotated about an axis between a position for the board copying mode and a position for the ordinary copying mode.

2. A board recording apparatus according to claim 1, wherein said copying unit support is provided on a support leg member for supporting said board unit.

3. A board recording apparatus according to claim 1, wherein said copying unit support is provided with an auxiliary support leg member at a position opposite to the center of rotation.

4. A board recording apparatus according to claim 1, wherein a face of said board unit to be read is parallel to the periphery of said photosensitive member in said board copying mode.

5. A board recording apparatus according to claim 4, wherein an original support member of said copying unit is positioned, in said board copying mode, opposite to a face of the board unit to be observed.

6. A board recording apparatus according to claim 4, wherein the face of said board unit is orthogonal to the transport direction of copy sheet in said copying unit in said ordinary copying mode.

7. A board recording apparatus according to claim 5, wherein an original support member of said copying unit is adapted, in said ordinary copying mode, to move in a direction parallel to the face of the board unit thereby exposing the original.

8. A board recording apparatus according to claim 4, wherein the transition between said board copying mode and said ordinary copying mode is achieved by a rotation by 90 degrees of the copying unit support.

9. A board recording apparatus capable of copying image information written on a sheet member with an electrophotographic copying unit, comprising:

a board unit provided with sheet supporting members for movably supporting a sheet member on which the image information is to be recorded, and an optical system for guiding the image information recorded on the sheet member onto the copying unit;

an electrophotographic copying unit provided with an electrophotographic photosensitive member and an original support; and a copying unit support for supporting said copying unit, adapted to be rotated about a support leg member for said board unit, between a position for the board copying mode and a position for the ordinary copying mode.

10. A board copying apparatus according to claim 9, wherein said copying unit support is provided with an auxiliary support leg member at a position opposite to the center of rotation.

11. A board recording apparatus according to claim 9, wherein the transition between said board copying mode and said ordinary copying mode is achieved by a rotation by 90 degrees of the copying unit support.

* * * * *

UNITED STATES PATENT AND TRADEMARK OFFICE

CERTIFICATE OF CORRECTION

PATENT NO. : 4,752,803

DATED : June 21, 1988

INVENTOR(S) : Mitsuru Sakurai, et al.

It is certified that error appears in the above-identified patent and that said Letters Patent is hereby corrected as shown below:

ON THE COVERSHEET, RIGHT-HAND COLUMN,

Line 7, change "and Scinto" to --& Scinto--.

COLUMN 1

Line 57, change "sheet 3" to --the sheet 3--.

Line 68, change "support" to --support,--.

COLUMN 2

Line 17, change "case use" to --case of use--.

Line 35, change "by additional" to --by an additional--.

Signed and Sealed this

Twenty-fifth Day of April, 1989

*Attest:*

DONALD J. QUIGG

*Attesting Officer*

*Commissioner of Patents and Trademarks*